United States Patent [19]

Ridders et al.

[11] Patent Number: 4,853,583

[45] Date of Patent: Aug. 1, 1989

[54] LOW-PRESSURE MERCURY VAPOR DISCHARGE LAMP HAVING A LAMP CAP WITH WALLS FOR GUIDING ELECTRODE LEADS PAST STARTER MEANS DISPOSED THEREIN

[75] Inventors: Johannes A. M. Ridders; Herman A. J. Reemers, both of Roosendaal, Netherlands

[73] Assignee: U.S. Philips Corporation, New York, N.Y.

[21] Appl. No.: 130,756

[22] Filed: Dec. 9, 1987

[30] Foreign Application Priority Data

Dec. 9, 1986 [NL] Netherlands ..... 8603127

[51] Int. Cl.[4] ..... H01J 61/30; H01J 61/36; H01J 61/56

[52] U.S. Cl. ..... 313/318; 313/493; 315/59; 439/616

[58] Field of Search ..... 313/493, 318; 315/58, 315/59; 439/226, 227, 616, 242, 246

[56] References Cited

U.S. PATENT DOCUMENTS

| | | | |
|---|---|---|---|
| 2,349,255 | 5/1944 | Epstein | 439/227 X |
| 4,462,602 | 1/1984 | Mollet et al. | 315/59 X |
| 4,672,263 | 6/1987 | Grahmann et al. | 313/493 |
| 4,689,521 | 8/1987 | Bjorkman | 313/493 |

FOREIGN PATENT DOCUMENTS

| | | | |
|---|---|---|---|
| 642848 | 6/1962 | Canada | 313/318 |
| 0061758 | 10/1982 | European Pat. Off. | 313/493 |
| 886042 | 8/1953 | Fed. Rep. of Germany | 313/318 |
| 1132658 | 7/1962 | Fed. Rep. of Germany | 313/318 |
| 117900 | 1/1947 | Sweden | 313/318 |
| 2077992 | 12/1981 | United Kingdom | 313/318 |

*Primary Examiner*—Palmer C. DeMeo
*Attorney, Agent, or Firm*—Brian Wieghaus

[57] ABSTRACT

Low-pressure mercury vapor discharge lamp having a discharge vessel which is sealed in a gastight manner and is formed in such a way that the ends at which the electrodes are located are adjacent. The ends are secured to a lamp cap having a shell accommodating a starter and possibly a capacitor. The shell has guide walls for guiding an inner pair of electrode leads past the starter. The electrode leads, starter leads and capacitor leads terminate near the open end of the shell for ease of connection. The open end is closed by a cover with a snap connection. Current connection pins are adjacent the shell and are aligned with an outer pair of electrode leads for ease of assembly.

9 Claims, 2 Drawing Sheets

LOW-PRESSURE MERCURY VAPOR DISCHARGE LAMP HAVING A LAMP CAP WITH WALLS FOR GUIDING ELECTRODE LEADS PAST STARTER MEANS DISPOSED THEREIN

BACKGROUND OF THE INVENTION

The invention relates to a low-pressure mercury vapor discharge lamp having a discharge vessel which is sealed in a gastight manner and is formed in such a way that the ends at which the electrodes are located are juxtaposed. The ends are secured to a lamp cap which is provided with a projecting wall part accommodating at least a starter and current connection pins are provided on either side of the projecting wall part. A lamp of this type is known from Dutch Patent Application No. 8003277 corresponding to U.S. Pat. No. 4,426,602 laid open to public inspection.

The lamp cap of the lamp described in said patent application mainly consists of a synthetic material and is formed to an integral unit. During the manufacture of such a lamp two juxtaposed electrode supply wires (one for each electrode) are first connected to the supply wires of a starter (and, if necessary, of a capacitor arranged parallel thereto), whereafter the lamp cap is connected to the discharge vessel (for example, by means of a suitable adhesive). The other supply wires of the electrodes are incorporated in the tubular current connection pins.

It has been found that the operation of placing the assembly of the discharge vessel with starter and supply wires in the projecting wall part and the current connection pins, respectively, requires great precision and is time-consuming when the lamp cap is definitively secured to the discharge vessel. Such a complicated step is undesirable notably in a bulk-manufacturing process.

SUMMARY OF THE INVENTION

It is the object of the invention to provide a lamp having a construction providing the possibility of simple manufacture in a bulk-manufacturing process.

According to the invention a low-pressure mercury vapor discharge lamp of the type described in the opening paragraph is therefore chracterized in that the lamp cap comprises a lamp base for securing the sealed ends of the discharge tube and a shell connected to the lamp base having a projecting wall part for holding the starter. The end of the projecting wall part of the lamp shell is closed by a cover.

Due to the construction of the lamp cap, the lamp according to the invention can be manufactured in a simple and reliable way in a bulk-manufacturing process.

Unlike the lamp cap of the known lamp, the end of the projecting wall part is not closed by the cover until all other operations on the lamp cap have been completed. During manufacture the shell (with the projecting cylindrically shaped wall part which is not yet closed) is first secured to the lamp base holding the discharge vessel. Then the starter and the anti-interference capacitor are introduced through the still open wall part and their supply wires connected to electrode supply wires. Finally the opening is closed by the cover.

In a preferred embodiment of the lamp according to the invention, the inside of the projecting wall part is provided with two juxtaposed or two oppositely located guide walls which are tapered in the direction of the cover and in which one supply wire of each electrode is incorporated, which supply wires are connected at least to the supply wires of the starter in the proximity of the cover.

This construction facilitates the connection of the supply wires for the electrodes to those of the starter and the capacitor. The said electrode supply wires are inserted through the narrowing guide walls and positioned near the end. This is very advantageous in a bulk-manufactured process.

The closure of the projecting wall part by means of the cover is preferably effected by welding or by means of a snap-connection.

BRIEF DESCRIPTION OF THE DRAWING

The invention will be described in greater detail with reference to the accompanying drawings in which.

DESCRIPTION OF THE PREFERRED EMBODIMENT

Figure 1:
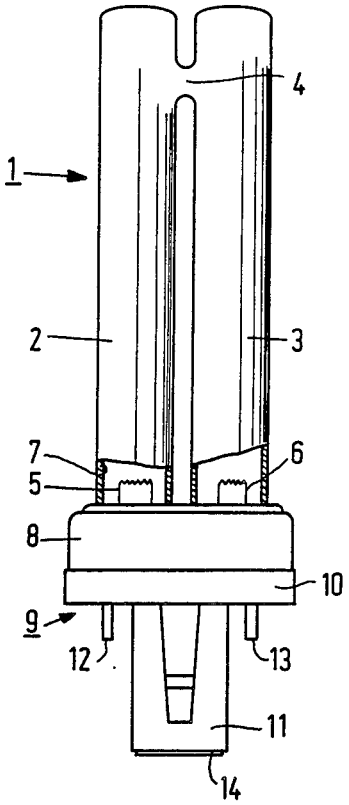
FIG. 1 shows an embodiment of a low-pressure mercury vapor discharge lamp according to the invention.

The low-pressure mercury vapor discharge lamp of FIG. 1 has a discharge vessel 1 filled with mercury and a rare gas which is sealed in a gastight manner and which comprises two parallel juxtaposed discharge tubes (2,3) which are connected together near their closed ends by means of the cross-connection 4. The electrodes 5 and 6 between which a U-shaped discharge is maintained during operation of the lamp are provided at the other ends of the tubes 2 and 3. A luminescent layer 7 which converts the radiation generated in the discharge into visible light is present on the inner wall of the discharge vessel. An oval shaped wall part or lamp base 8 (for example, consisting of aluminum) of the lamp cap 9 is secured by means of an adhesive (such as cement) to the ends of the discharge vessel at which the electrodes are located. A synthetic material shell 10 is secured to the oval lamp base 8 by means of a riveted connection. The shell 10 is provided with a cylindrically shaped wall part 11 projecting in the axial direction and accommodating a glow starter and a capacitor (not visible in FIG. 1). This cylindrically shaped part has a rectangular cross-section. Current connection pins 12 and 13 are present on either side of part 11. The end of part 11 is closed by a synthetic material cover 14, for example by means of a snap-connection.

FIG. 2 shows diagrammatically a number of steps in the manufacturing process of the lamp from which it is apparent that the construction according to the invention has clear advantages.

In the manufacture of the lamp the lamp cap with the still open part 11 is first secured to the discharge vessel, whereafter the starter and the capacitor are provided and the part 11 is closed by the cover 14.

Figures 2A, 2B, 2C:
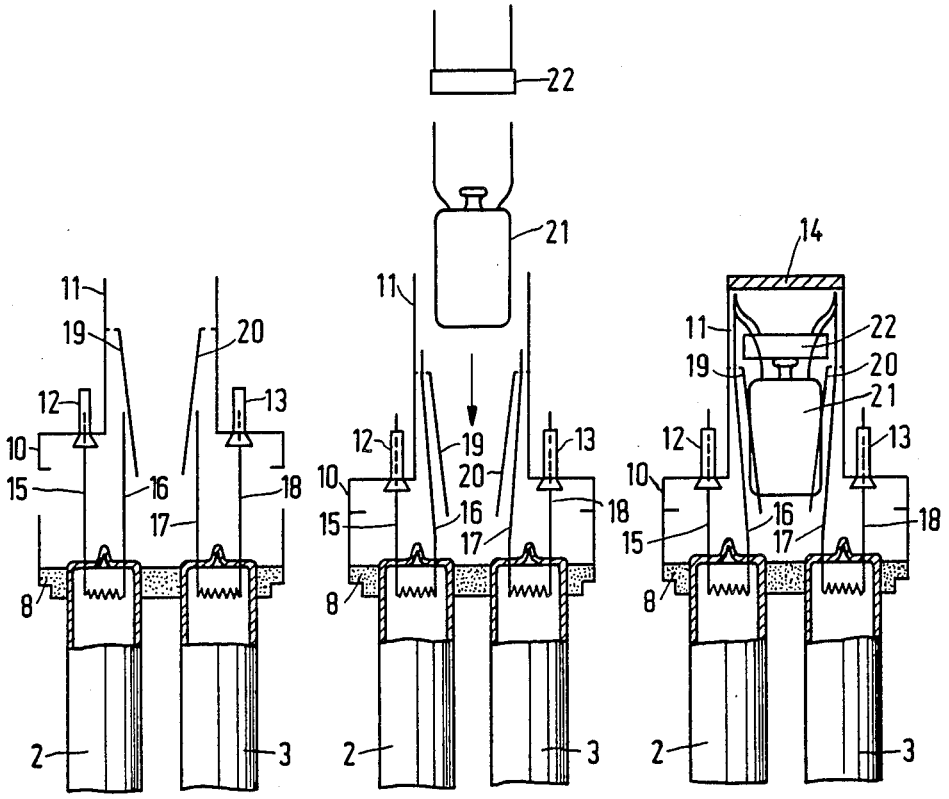
FIGS. 2*a–c* diagrammatically show three steps in a process of manufacturing the lamp of FIG. 1.

FIG. 2*a* shows a first process step. The oval aluminum lamp base 8 is already secured to the discharge vessel. The still open lamp shell 10 is subsequently provided by moving it over the parallel projecting supply wires 15, 16, 17 and 18. The supply wires 15 and 18 are thereby incorporated in the cylindrically shaped current connection pins 12 and 13, while the wires 16 and 17 (a supply wire for different electrodes) are incorporated in two funnel-shaped guide walls 19 and 20 facing each other on the inner side of the cap. A guiding lead-in space is then formed for the said wires. The walls 19 and 20 substantially face each other (see also FIG. 3). Upon further connection of 10 to 8, the wires 16 and 17 extend as far as the end of the lamp cap (see FIG. 2*b* showing the situation in which the parts 8 and 10 are connected together). Subsequently the starter 21 and the capacitor 22 (whose supply wires extend in the same direction as the supply wires 16 and 17 of the electrodes) are inserted into part 11 via the still open end and are connected to the supply wires 16 and 17 (for example, by means of soldering). Subsequently part 11 is closed by cover 14. This is shown in FIG. 2*c*.

Figure 3:
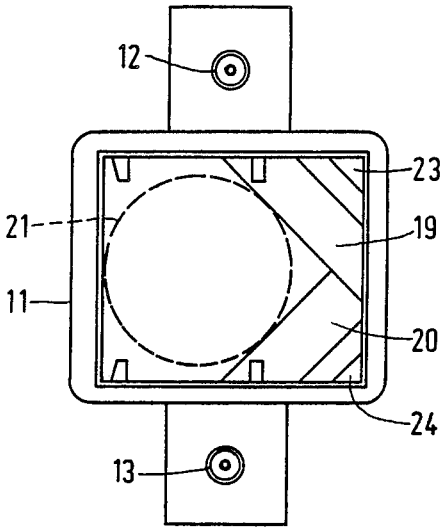
FIG. 3 is a cross-section of the lamp cap of a lamp according to the invention in which the discharge vessel comprises four interconnected tubular parts placed in a square.

Due to the presence of a discharge vessel having four tubular parts placed in a square, the synthetic material cap 11 in FIG. 3 has a square shape in the cross-section.

The walls 19 and 20 for guiding the supply wires are visible. The openings 23 and 24 at the constricted ends of the walls 19 and 20 are large enough to allow the ends of the wires 16 and 17 to pass. Furthermore, the starter 21 is shown by means of a broken line.

In a practical embodiment of the lamp according to FIG. 1, the length of the tubular parts is approximately 13 cm, the internal diameter is 10 mm. For a rare-gas filling of argon (3 torr) the light output was approximately 600 lumen at a power supply to the lamp of approximately 9 W.

What is claimed is:

1. In a low pressure discharge lamp having a sealed discharge device defining a lamp axis with a pair of adjacent sealed ends, a discharge electrode disposed in each sealed end between which a discharge is maintained during lamp operation, a lamp base in which said sealed ends are secured for supporting said discharge device, starter means for starting the discharge device, and a shell connected to said lamp base in which said starter means is disposed, the improvement comprising:

each discharge electrode having a pair of electrode leads extending through a respective sealed end, the leads extending from said sealed ends furthest from each other defining an outer pair of electrode leads and the leads closest to each other defining an inner pair of electrode leads;

said shell being open at its end furthest from said discharge vessel and having a pair of openings at its end near said discharge vessel for receiving a respective inner electrode lead, and said shell having guide means for guiding each inner electrode lead around said starter means towards said open end;

said starter means having a pair of starter leads terminating near said open end, each of said inner electrode leads passing through a respective opening, around said starter means through said guide means, and connected to a respective starter lead near said shell open end; and a pair of tubular current connection pins extending from said shell parallel to said lamp axis each having a bore for receiving a respective outer electrode lead, each current connection pin being aligned with a respective outer electrode lead and each outer electrode lead extending parallel to the lamp axis and being received in the bore of a respective current-connection pin.

2. A lamp as claimed in claim 1, wherein said lamp has a cover secured to said shell for closing said open end.

3. A lamp as claimed in claim 2, wherein said cover is secured to said shell by a snap connection.

4. A lamp as claimed in claim 1, wherein each current-connection pin has a flared portion at its end facing said electrodes for guiding a respective outer electrode lead into said bore.

5. A lamp as claimed in claim 1, wherein said shell has a rectangular cross section defining two adjacent interior corners, and said guide means comprises a pair of guide walls each facing a respective one of said adjacent corners and tapering towards a respective corner in the direction of said shell open end, an aperture being present between each guide wall and its respective corner for allowing the passage of said inner electrode leads.

6. A lamp as claimed in claim 5, wherein each current-connection pin has a flared portion at its end facing said electrodes for guiding a respective outer electrode lead into said bore.

7. A lamp as claimed in claim 6, wherein said lamp has a cover secured to said shell for closing said open end.

8. A lamp as claimed in claim 5, wherein said lamp further comprises a capacitor disposed in said shell electrically connected in parallel with said starter means, and said capacitor having a pair of capacitor leads terminating near said shell open end each connected to a respective starter lead and inner electrode lead.

9. A lamp as claimed in claim 8, wherein said starter means comprises a glow starter.

* * * * *